United States Patent [19]

Klappert

[11] Patent Number: 4,467,632

[45] Date of Patent: Aug. 28, 1984

[54] METHOD OF MAKING A WOUND CORE FOR AN ELECTRIC TRANSFORMER

[75] Inventor: Willi Klappert, Hickory, N.C.

[73] Assignee: General Electric Company, King of Prussia, Pa.

[21] Appl. No.: 365,206

[22] Filed: Apr. 5, 1982

[51] Int. Cl.[3] ..... B21C 47/04; H01F 3/04

[52] U.S. Cl. ..... 72/147; 29/605

[58] Field of Search ..... 29/596, 605, 609; 72/146, 147, 148, 371

[56] References Cited

U.S. PATENT DOCUMENTS

| | | | |
|---|---|---|---|
| 2,257,760 | 10/1941 | Nyberg | 72/147 |
| 3,027,628 | 4/1962 | Wilk et al. | 29/155.57 |
| 3,186,066 | 6/1965 | Metzger | 29/155.57 |
| 3,557,592 | 1/1971 | Corns | 72/146 |
| 4,160,371 | 7/1979 | Wilkening et al. | 72/147 |
| 4,347,723 | 9/1982 | Bradlee | 72/147 X |

*Primary Examiner*—E. Michael Combs
*Attorney, Agent, or Firm*—William Freedman

[57] ABSTRACT

In this method, a plurality of elongated sheets of magentic steel are provided, and these sheets are wound in superposed relationship about an arbor, thereby forming an annulus of gradually increasing diameter about the arbor. As the sheets are so wound, any telescoping action by the sheets and the direction thereof are sensed. Following the occurrence of a predetermined amount of said telescoping in a sheet, I provide sheets that subsequently enter the annulus with thickening means effectively thickening said subsequent sheets at one side relative to their other side, said one side being located at a side of the thickened sheet's longitudinal center-line opposite to the direction in which said telescoping occurs.

The article made by this method is also disclosed and claimed.

15 Claims, 15 Drawing Figures

METHOD OF MAKING A WOUND CORE FOR AN ELECTRIC TRANSFORMER

BACKGROUND

This invention relates to a method of making a wound core for an electric transformer and, more particularly, relates to a method of this type in which a plurality of sheets primarily of magnetic steel are wound in superposed relationship about an arbor. The invention is also concerned with the core resulting from this method.

The method of this invention is preferably practiced with a high-speed machine that winds the sheets in rapid succession about the arbor, building up an annulus of gradually increasing diameter. When the required number of sheets have been wound in superposed relationship about the arbor, the resulting annulus is removed from the arbor and subjected to further processing, soon to be described.

A problem that is often encountered in practicing a method of the above type is that the sheets may have a tendency to "telescope" as they are wound about the arbor. The term "telescope", as used herein, denotes the tendency of the trailing edge of the sheet to become laterally displaced from the leading edge during the winding operation. The direction of the telescoping is the direction, considered axially of the arbor, that the trailing edge is displaced from the leading edge after the sheet is so wound. The magnitude of such displacement is referred to herein as the amount of telescoping. For various reasons, soon to be explained, telescoping, if it exceeds a predetermined amount, is highly objectionable.

Various solutions have been proposed for correcting the telescoping action and/or its results. One solution has been to place one side face of the finished annulus on a flat horizontal surface and to gently hammer the opposite side face of the annulus in such locations as to force the protruding telescoping sheets back into approximate edge-alignment with the other sheets. Thereafter, the side faces are placed between two planar members, and these planar members are pressed together to further improve the alignment of the edges of the sheets.

This approach works reasonably well if the sheets are relatively thick, e.g., 11 mils, and thus can usually withstand the above-described hammering and pressing without damage. But there is a growing movement in the industry to shift to thinner and thinner sheets, and such sheets are much more susceptible to being damaged by such hammering and pressing.

It is to be noted that the greater the amount of telescoping, the more susceptible the sheets are to being damaged by the above-described hammering or pressing since the greater the sheets protrude at their lateral edges, the less support they have in this region and the more easily deformed they are by edge-applied forces.

Other solutions proposed for the telescoping problem have been aimed at preventing the occurrence of substantial telescoping. One such proposed solution has involved feeding sheets onto the arbor so that their center lines are slightly angularly displaced from a reference plane perpendicular to the arbor axis. This approach is awkward and has not been very effective in limiting telescoping to the desired extent.

Still another proposed solution has been to provide means responsive to telescoping for angularly shifting the planar face of the sheets as they are fed onto the arbor. This approach likewise has not been very effective in limiting telescoping to the desired extent.

SUMMARY

An object of my invention is to provide a simple and effective method for limiting the above-described telescoping action when applied to a core-making method involving winding sheets in superposed relationship about an arbor.

Another object is to provide an annular form of magnetic steel that is made by utilizing a method capable of attaining the immediately-preceding object.

Another object is to provide a simple method for making a wound core from steel sheets that is highly effective in limiting telescoping irrespective, for the most part, of the cause of the telescoping, e.g., whether it is due to variations in the thickness of the steel, burrs along one edge of the sheet, stresses or camber in the sheet, waviness of the sheet surface, or variations in thickness of the usual insulation on the sheet.

In carrying out the invention in one form, I make a wound core by the following method. I provide a plurality of elongated sheets primarily of magnetic steel, each having a longitudinally-extending center line located between laterally-opposed sides of the sheet. The sheets are wound in superposed relationship about an arbor, thereby forming an annulus of gradually-increasing diameter about the arbor. As the sheets are so wound, any telescoping action by the sheets and the direction thereof are sensed. Following the occurrence of a predetermined amount of said telescoping action in a sheet, I provide sheets that subsequently enter said annulus with thickening means effectively thickening said subsequent sheets at one side relative to the other side, said one side being located at a side of the sheet center line opposite to the direction in which said telescoping occurs. When a predetermined number of said sheets have been wound about the arbor, the resulting annulus is removed from the arbor.

BRIEF DESCRIPTION OF DRAWINGS

For a better understanding of the invention, reference may be had to the following description taken in connection with the accompanying drawings, wherein:

FIG. 1 is divided into an A portion and a B portion. The A portion should be thought of as being located to the right of the B portion, with the dotted-line portions of sheet 10 being horizontally aligned.

DETAILED DESCRIPTION OF PREFERRED EMBODIMENTS

Figure 1A:
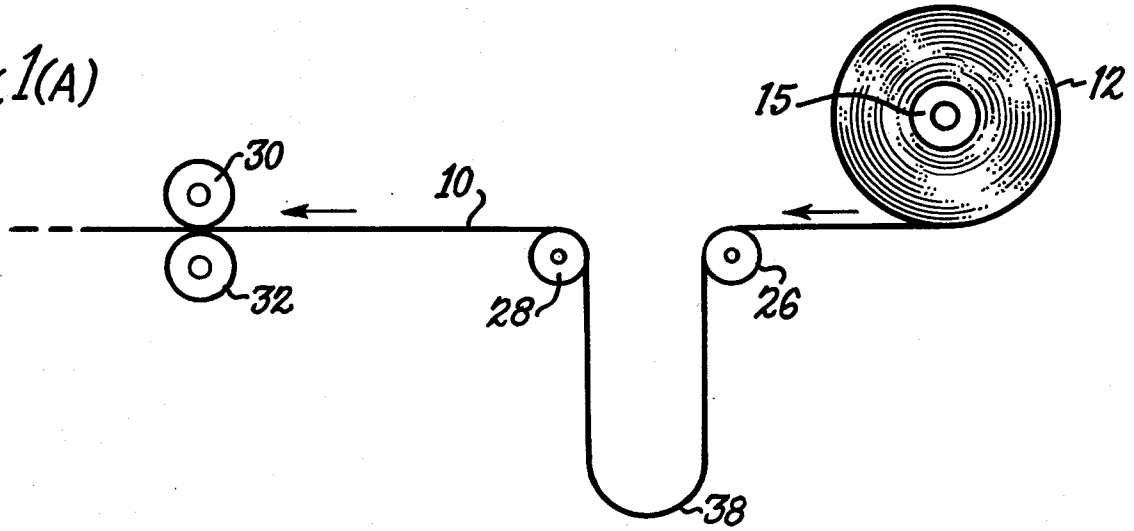
FIG. 1 is a diagrammatic illustration of one form of core-making apparatus for carrying out the method of the present invention.
Figure 1B:
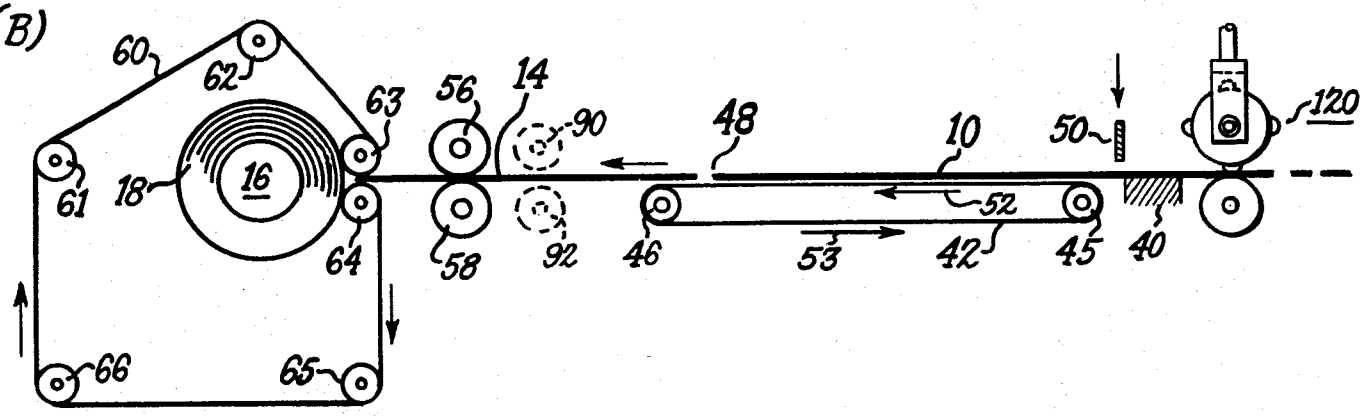

Referring now to FIG. 1, there is shown a silicon steel sheet 10, referred to hereinafter as a parent sheet. This sheet has a thin insulating coating on it made, for example, from magnesium hydroxide. A large roll of this silicon steel sheet is shown in FIG. 1(A) at 12, and from this roll the parent sheet 10 is unwound and then cut into shorter sheets 14, as shown in FIG. 1(B). These shorter sheets 14 are then wound about an arbor 16 to form an annulus 18 of gradually increasing diameter. When the desired number of sheets 14 have been wound into the annulus 18, the annulus is removed from the arbor 16 and suitably processed to form the core of a distribution transformer.

The parent sheet 10 is unwound from the roll 12 by driving a supporting shaft 15 for the roll in a clockwise direction. As the parent sheet 10 is unwound from the roll 12, it is driven to the left in FIG. 1 by means of a pair of diametrically-opposed driving rollers 30, 32. Suitably controlled electric motors (not shown) are coupled to the shaft 15 and the driving rollers 30, 32 for rotating them at appropriate speeds. Between the roll 12 and the driving rollers 30, 32 there are two horizontally-spaced guides 26 and 28 between which there is a loop 38 in the parent sheet 10 that is allowed to develop to take up any slack in the sheet 10.

Referring to FIG. 1B, the left hand end of the sheet 10, after passing to the left beyond rollers 30, 32, is supported on a table 40 and a belt 42. The belt 42 extends around a pair of horizontally-spaced pulleys 45 and 46 and provides a horizontal surface just beneath the sheet 10. When the forward end 48 of parent sheet reaches the proper position determined by a suitable control (not shown), leftward motion of the sheet 10 is terminated, and the sheet 10 is cut by a suitable shearing blade 50. Such cutting is effected by driving the blade 50 downward, severing the sheet 10 by a shearing action between blade 50 and a surface on table 40. The blade is then immediately raised to its illustrated position of FIG. 1A. This cutting of parent sheet 10 produces a shorter sheet 14 to the left of blade 50, and the shorter sheet 14 drops onto the horizontal upper portion of belt 42.

The belt 42 had been at rest just preceding the cutting step and until cutting had been completed. When cutting is completed, the belt 42 is activated and driven by pulley 46 in the direction of the arrows 52 and 53. This drives the forward end of the shorter sheet 14 to the left into a set of synchronizing rollers 56, 58. These rollers 56, 58 drive the sheet 14 to the left onto the outer periphery of the annulus 18 that is being wound on the arbor 16.

For pressing the sheet 14 against the outer periphery of the annulus 18 as it is wound about this outer periphery, a belt 60 encircling the arbor is provided. This belt 60 passes around a series of pulleys 61–66 and also around the outer periphery of the annulus 18 and arbor 16, as illustrated in FIG. 1B. The belt and pulleys act in a conventional manner to wrap the sheets 14 about the annulus 18 as the arbor 16 rotates. The speed of the synchronizing rollers 56, 58 is controlled so as to drive the sheet 14 at the same speed as the sheet 14 is driven by the belt 60.

Figure 2:
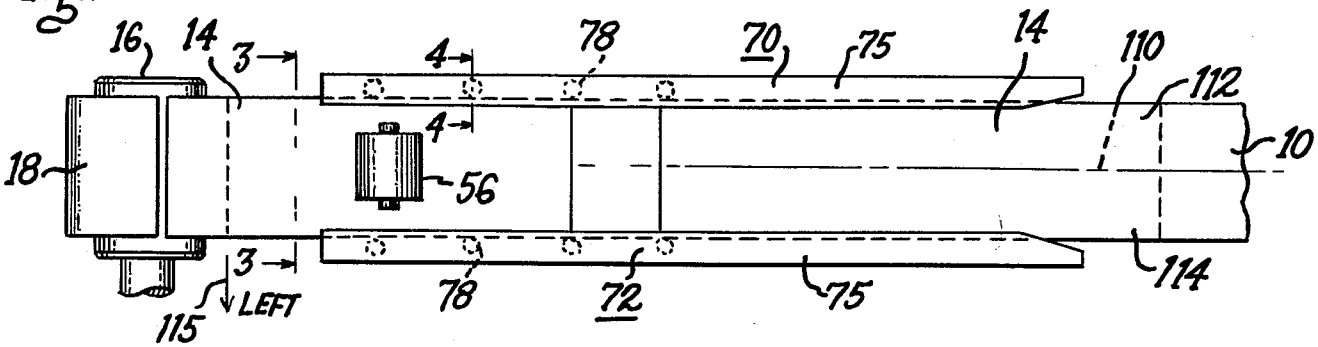
FIG. 2 is a schematic showing of the apparatus of FIG. 1, viewed in plan and omitting certain parts for clarity.
Figure 3:
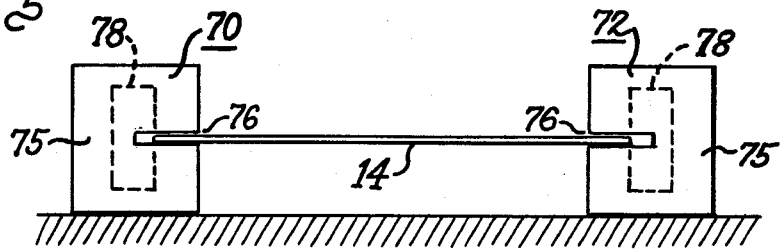
FIG. 3 is an enlarged sectional view along the line 3—3 of FIG. 2.
Figure 4:
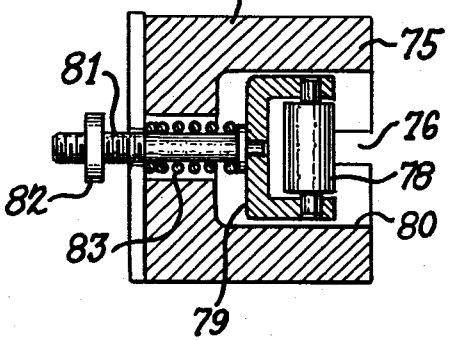
FIG. 4 is an enlarged sectional view along the line 4—4 of FIG. 2.

Each sheet 14, following its separation from the parent sheet 10, is guided for substantially horizontal motion as it passes onto the arbor 16. Such guiding action is effected by a pair of stationary guides 70 and 72 located at opposite edges of the sheet. These guides are best illustrated in FIGS. 2–4.

Each guide comprises a body portion 75 having a horizontal slot 76 therein for receiving one side edge of the sheet 14. At spaced locations along the length of the guide, there are roller bearings 78, each having a vertical axis. As shown in FIG. 4, each of these roller bearings 78 is carried by a U-shaped support 79 that is slidably mounted for horizontal motion in a cavity 80 in body portion 75. A shaft 81 extends from the rear of support 79 through an opening in the body portion 75 and has a stop 82 fixed thereto for limiting inward horizontal motion of the bearing 78 and its support 79. Each bearing 78 is spring-biased in an inward direction by a compression spring 83.

The speed of belt 42 is so controlled that the belt drives the most-recently cut sheet 14 into a position where its forward edge is in immediate proximity to the trailing edge of the immediately-preceding sheet 14. The immediately-preceding sheet is then being driven by the synchronizing rolls 56 and 58. When these edges have the desired gap between them, the two sheets are driven forward in synchronism to maintain this gap constant. For driving the trailing sheet in synchronism with the forward sheet during this interval, another set of synchronizing rollers (shown in dotted lines at 90, 92 in FIG. 1B) drives the trailing sheet forward until this sheet enters the first set of synchronizing rollers 56, 58. The rollers 90, 92 are then separated to release the trailing sheet, which continues forward under the control of rollers 56, 58. The rollers 90, 92 remain separated until the next sheet 14 arrives and then are brought together to repeat their above-described action.

The core-making apparatus as described in this "Detailed Description" up to this point is part of the prior art and is not my invention.

As pointed out hereinabove under "Background", a problem that is often encountered when making a core by winding sheets about an arbor is that the sheets may telescope as they are so wound. As pointed out under "Background", telescoping denotes the tendency of the trailing edge of the sheet to become laterally displaced from the leading edge during the winding operation. The direction of the telescoping is the direction, considered axially of the arbor, that the trailing edge is displaced from the leading edge after the sheet is so wound. The magnitude of such displacement is referred to herein as the amount of telescoping.

Figure 5:
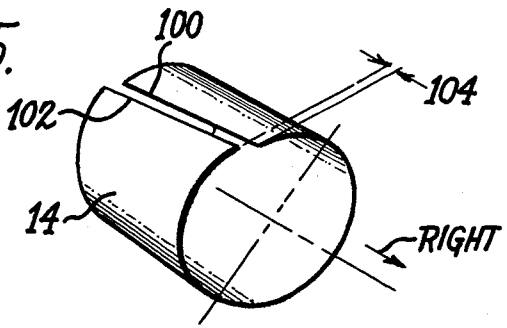
FIG. 5 is a diagrammatic view of a single sheet in its wound condition.

FIG. 5 shows a sheet 14 that has telescoped during the winding operation. Its trailing edge 100 has been displaced to the right from its leading edge 102. The amount of telescoping is the dimension 104.

Figure 6:
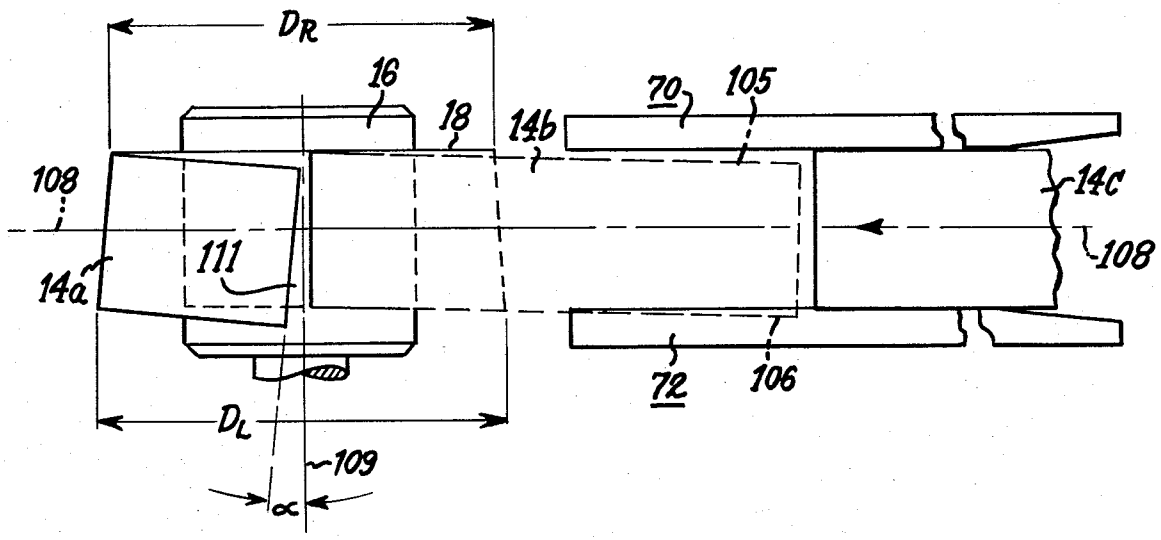
FIG. 6 is another diagrammatic view showing how the trailing end of a sheet that is being wound reflects telescoping.

This telescoping action is reflected in the position of the trailing edge of the sheet while the sheet is still partially in the guides 70 and 72. This is illustrated in FIG. 6 where a partially wound sheet 14b is shown with its trailing portion depicted by dotted lines. The lateral edges 105 and 106 of the sheet 14b are shown skewed at an angle to a reference plane 108 perpendicular to the central axis 109 of the arbor 16. The trailing edge of telescoping sheet 14b is shown at an angle to the leading edge of the sheet 14c that follows 14b. Similarly, the leading edge of sheet 14b is shown at an angle $\alpha$ with respect to the trailing edge of the already-wound and telescoping preceding sheet 14a. An effect of this telescoping action is to make the annulus 18 larger in diameter at one end than it is at its opposite end. This effect, as a result of telescoping in preceding sheets, has caused diameter $D_L$ of annulus 18 to be larger than diameter $D_R$. If permitted to continue, this effect will usually become cumulative, further increasing the difference in these diameters. For numerous reasons, soon to be described, this is a highly undesirable condition.

My invention provides a simple and highly effective way of substantially reducing the amount of telescoping. In practicing the invention in one form, I first sense any telescoping that is occurring, both with respect to its amount and direction. When such telescoping reaches a predetermined value, I take steps to effectively thicken one side of the sheets that subsequently enter the annular 18 with respect to their other side. The particular side selected for thickening is of crucial importance.

To explain this in more detail, note the sheet 14 in the right-hand half of FIG. 2. It has a center line 110 extending along its length, and this longitudinally-extending center line divides the sheet into two sides 112 and 114 located at opposite sides of the center line. If I had found that excessive telescoping was occurring in the direction of arrow 115 of FIG. 2, which will be assumed as pointing to the left, I would make the opposite, or right-hand side 112 of the sheet 14 effectively thicker. Conversely, if I had found that telescoping was occurring to the right, I would make the left hand side of sheet 14 effectively thicker than its right hand side.

Figure 10:
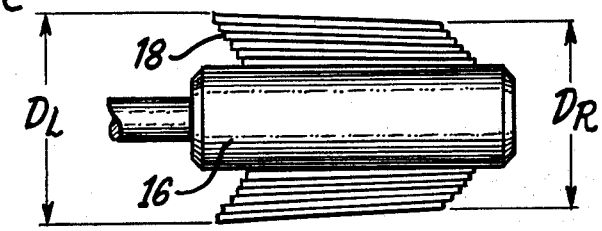
FIG. 10 is a schematic cross-sectional view through a partially wound annulus showing in exaggerated form the effect of telescoping.

To illustrate more clearly why this procedure is effective, reference may be had to FIG. 10, which is a schematic cross-sectional view through a partially wound annulus 18 that has telescoped to the left. Its diameter $D_L$ at its left hand end is larger than its diameter $D_R$ at its right hand end. It will be seen that if the next group of sheets added to the annulus of FIG. 10 were thicker at their right hand side than at their left, they would tend to equalize the diameters $D_R$ and $D_L$ of the annulus 18 at its opposite ends.

In a preferred form of my invention, this increase in effective sheet-thickness is accomplished by providing the parent sheet 10 with embossments projecting from its lower surface at spaced-apart locations along the length of the parent sheet on the appropriate side of the sheet. The means for applying these embossments is shown as 120 in FIG. 1 and is located upstream of the blade 50 so that the material of sheet 14 will have these embossments on it before the sheet 14 is actually separated from the parent sheet 10.

Figure 7:
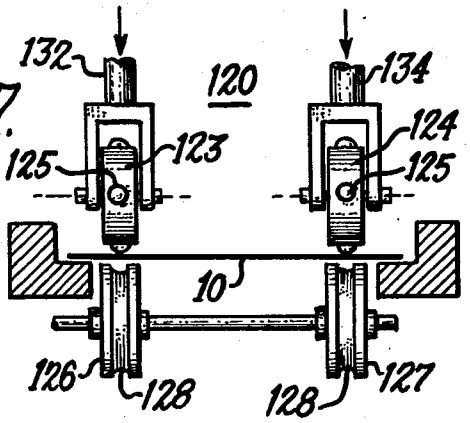
FIG. 7 is an enlarged sectional view along the line 7—7 of FIG. 8 showing the indenting means for embossing the steel sheet.
Figure 9:
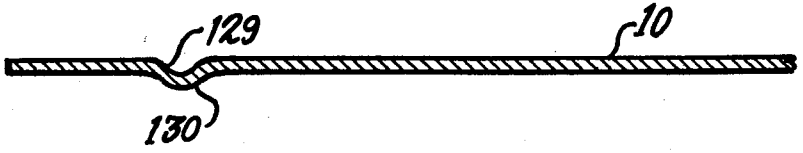
FIG. 9 is a sectional view through the sheet along the line 9—9 of FIG. 8.
Figure 8:
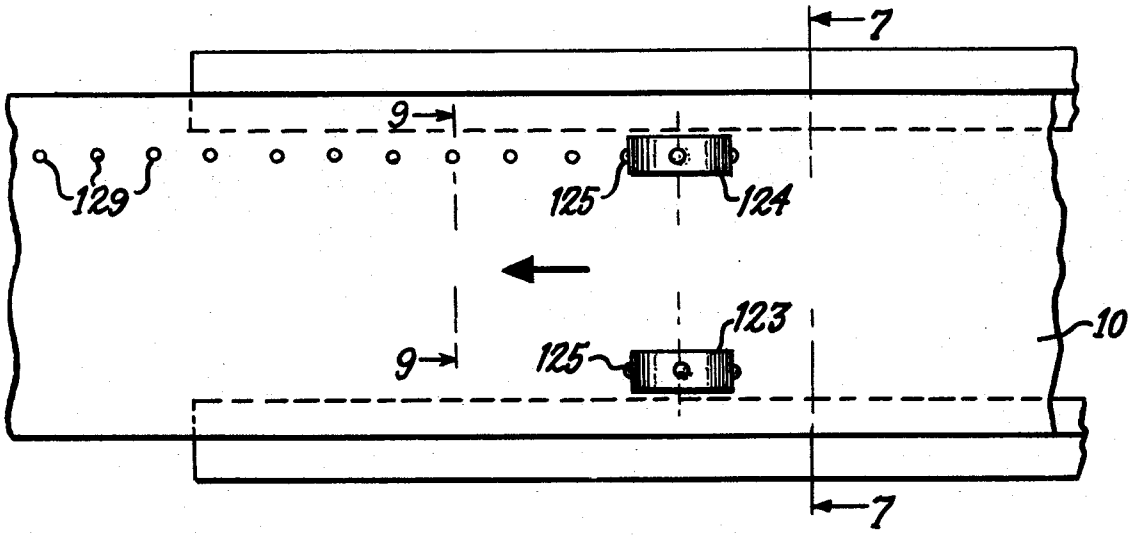
FIG. 8 is a plan view, partially schematic, of the apparatus of FIG. 7.

A more detailed showing of the embossment-applying means 120 is contained in FIGS. 7 and 8. This means 120 comprises two upper rolls 123 and 124 mounted at opposite sides of the sheet 10 and containing protuberances 125 at angularly-spaced locations on the periphery of each roll. Mounted in vertical alignment with upper rolls 123 and 124 are two lower rolls 126 and 127, respectively. Each of the lower rolls has a circumferentially-extending groove 128 in its periphery. Referring to FIG. 7, when embossments are called for at the left hand side of the sheet 10, the left-hand roll 123 is driven downwardly until its periphery engages the sheet 10. After this has occurred, motion of the sheet 10 past the roll 123 causes the roll to rotate, and this causes the protuberances 125 to successively engage and form indentations 129 in the left-hand portion of the upper surface of the sheet at spaced locations along its length. The groove in the lower roll allows the lower surface of the sheet to be deformed by these indentations, such deformation taking the form of spaced-apart embossments 130, as shown in FIG. 9.

For driving the roll 123 downwardly and for holding it depressed with sufficient force to make the desired embossments, a compressed-air actuated piston (not shown) is coupled to the roll 123 through a rod 132. When the embossments are no longer called for to counteract telescoping, the piston is released and the roll 123 is suitably reset to its elevated inactive position.

When embossments are called for on the right hand-side of the sheet 10 of FIG. 7, the right-hand roll 124 is actuated in the same manner as described hereinabove with respect to the left-hand roll 123. An actuated rod 134 transmits vertical forces to roll 124 from a compressed-air motor (not shown).

The amount of telescoping that is occurring can be sensed in a number of different ways. One way is through simple visual observation by the operator of the equipment. As one option, he can observe the sheets when they are in the approximate position of FIG. 6 and see how skewed the edges 105 and 106 of the sheet are and in what direction they are skewed. In FIG. 6, the skew represents telescoping to the left, or in the downward direction depicted.

As a second option, he can observe the edges of the annulus 18 that is being wound on the arbor 16 and see how far out from the body of the annulus the trailing edges of the most-recently wound sheets are projecting and from which edge of the annulus they are projecting.

As soon as he determines that excessive telescoping is occurring in a given direction, he actuates a control which causes embossments to be applied to sheet 10 at a side of the sheet opposite to the direction of telescoping. More specifically, if excess telescoping is to the left, he actuates the "start" control for the right-hand roller 124 of FIG. 7, causing this roller 124 to begin producing embossments. Conversely, if excess telescoping is to the right, he actuates the "start" control for the lefthand roll 123. When the appropriately embossed sheets are wound onto the annulus 18, the amount of telescoping begins to decrease.

The operator allows the appropriate roll 123 or 124, as the case may be, to continue making embossments until he observes that telescoping has been substantially eliminated, at which time he actuates a control that lifts the embossing roller and discontinues the embossing operation. If excessive telescoping should again appear, the operator repeats the embossing operation until telescoping is again substantially eliminated.

Instead of manually controlling the embossing operation, as above described, it is usually preferred to automatically control it. In an automatic control, the control performs automatically the same steps as performed in the above sequence by the operator. In one form of automatic control, the amount and direction of the telescoping action are sensed by sensing the position of the shaft 81 shown in the guide 70 of FIG. 4 and a corresponding shaft 81 (not shown) in the guide 72 at the opposite edge of the sheet 14. When the illustrated shaft 81 is displaced to the left by the skewed left hand edge of the sheet 14 and such displacement exceeds a predetermined amount, the "start" control for the right-hand embossing roll 124 is actuated to initiate embossing action by this roll 124. This embossing action continues until the shaft 81 of FIG. 4 returns to the right to its normal position for a predetermined time, indicating that telescoping has been substantially eliminated. This occurrence causes the control to discontinue the embossing action.

Another way of sensing telescoping is to measure constantly, or at frequent intervals, the diameter of the annulus 18 at each of its opposite ends as it is being wound. This measuring can be done by suitable optical means (not shown) without interrupting the winding operation. As pointed out hereinabove, telescoping in a given direction results in the end of the annulus in the direction of telescoping developing a larger diameter than the other end of the annulus. When this difference exceeds a predetermined amount, the control causes the embossing roller at the opposite side of the center line 110 of sheet 10 to start an embossing operation. As the appropriately embossed sheets 14 are wound onto the annulus 18, the difference in diameters at opposite ends of the annulus decreases. Such embossing action continues until the difference value returns to substantially zero, at which time embossing is discontinued.

The above-described telescoping action can be caused by a wide variety of factors, such as, for example, one or more of the following: thickness variations as a result of unequal pressure applied to the steel during rolling in the course of initial forming of the sheet stock, burrs along the edge of the sheet as a result of slitting to produce sheet 10 from wider sheet stock, stresses in the steel, camber in the sheet, waviness of the sheet surface, and uneven application of the thin insulating coating on the steel. An exceptional advantage of my method of counteracting telescoping is that it works effectively irrespective of which of these factors is responsible for the telescoping action. More specifically, irrespective of why the annulus is telescoping and its diameter is becoming larger at one end than the other as it is being wound, if I effectively thicken the subsequently-applied sheets at their side opposite to the direction of telescoping, I reduce the difference between the diameters and counteract telescoping.

When the desired number of sheets 14 have been wound on the arbor 16 and the annulus 18 has reached the desired diameter, an outer locking turn (not shown) is applied about the already-wound turns in preparation for removal of the annulus from the arbor. This outer turn preferably comprises a ring having overlapping portions with suitable locking means for interlocking the ends so as to prevent the annulus from unwinding. The resulting annulus is then removed from the arbor.

Thereafter, the annulus is placed with its side face resting on a flat horizontal surface, and its other, or exposed, side face is gently hammered in such locations as to force any protruding sheets 14 back into approximate edge-alignment with the other sheets. Then, the two side faces are placed between two planar members, and these planar members are pressed together to further improve the alignment of the edges of the sheets.

This hammering and pressing procedure has been used heretofore and works reasonably well despite telescoping if the sheets are relatively thick, e.g., 11 mils. Such sheets can usually withstand the hammering and pressing without damage, even when there has been a relatively large amount of telescoping. But with thinner sheets, e.g., about 9 mils or less, the sheets are more susceptible to damage from the hammering and pressing, and it is especially important to limit telescoping to a relatively low value in order to prevent the sheets from being damaged by such hammering and pressing. Using the embossing procedure described hereinabove, I can limit telescoping to a sufficiently low value that the hammering and pressing steps can be carried out with a relatively low chance for damaging any protruding sheets.

The embossments 130 also contribute to the ease with which the protruding rings can be slid back into their proper position. The embossments limit the area of contact that an embossed ring has with an immediately-adjacent ring, and this reduces the frictional opposition to sliding of the embossed ring on the immediately-adjacent ring back into its proper position during hammering or pressing.

After the annulus 18 has been removed from the arbor and its side faces hammered and pressed to render them planar, the annulus is subjected to a conventional forming operation (as disclosed, for example, at 56 in U.S. Pat. No. 3,327,373—Somerville) that gives it a generally rectangular form suitable for use as a transformer core. The rings 14, which are then generally rectangular constitute the laminations of the core. This rectangular form is then annealed in a conventional manner to substantially remove the stresses previously developed in the steel.

Following annealing, the outer locking ring is removed and the core is linked with a preformed coil. This linking is performed by a conventional and well-known core-lacing operation that involves removing single laminations or packets of laminations from the core and lacing them about the preformed coil. After all the laminations have been so laced, the outer locking ring is reapplied.

It is necessary that any needed correction for telescoping be made before the forming, annealing, and lacing steps are performed. Any attempt to correct the telescoping after annealing will produce undesirable stresses in the laminations. Also, a telescoped core is very difficult to lace.

Figure 11:
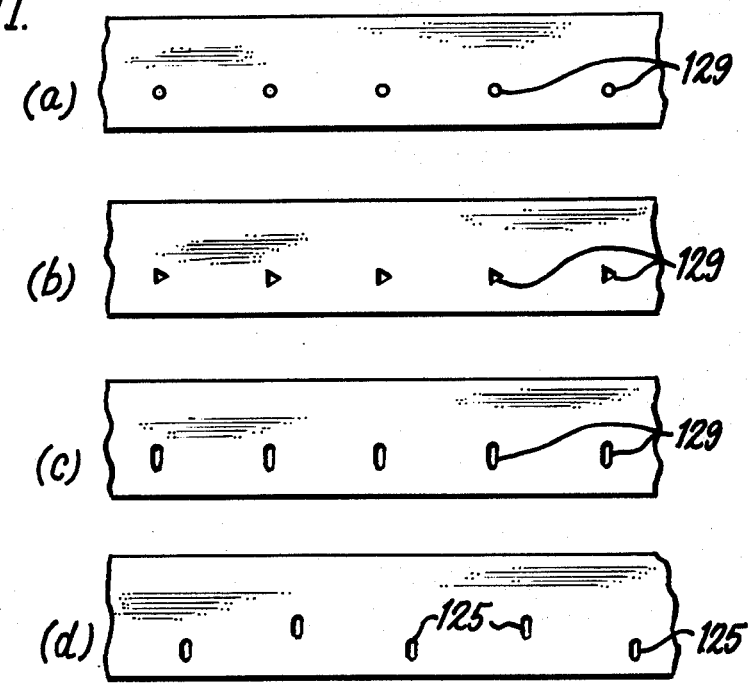
FIGS. 11*a*, 11*b*, 11*c*, and 11*d* shows various forms of indentations that can be used for embossing the steel sheet.

Although I have shown in FIG. 7, indenting means (125) that is generally hemispherical in shape, it is to be understood that other shapes can instead be used for the indenting means. Indentations 129 made by some of these shapes are shown in FIG. 11. FIG. 11*a* shows the indentations from the hemispherical indenting means. FIG. 11*b* shows the indentations from a triangular die having a sharp point. FIG. 11*c* shows a plurality of spaced-apart elongated indentations, each extending laterally of the sheet. FIG. 11*d* shows indentations similar to those of FIG. 11*c* except that instead of all being uniformly spaced from the edge of sheet, they are staggered, i.e., alternate ones are spaced from the edge by different amounts.

It will be apparent that if, in the wound annulus, the indentations of one sheet precisely nested in those of the previously-wound sheet, then the indentations on the one sheet would have no significant effect in thickening the one sheet. It is primarily to reduce the chances for this happening that I utilize the staggered embossment pattern of FIG. 11*d*.

The elongated slot configuration of FIGS. 11*c* and 11*d* is advantageous in that it provides a relatively large area embossment for supporting the sheet 14 on its adjacent sheet, yet at the same time its relatively small dimension considered along the length of the sheet results in less frictional opposition to transverse movement of the sheet when it is being hammered or pressed back into alignment as part of the above-described procedure for correcting any telescoping that may have occurred.

It is highly desirable that the embossments be present along the entire length of each embossed sheet. If they were concentrated in a localized area, this would tend to cause the annulus 18 to develop an undesirable peripheral bulge in the region of the embossments as the embossed sheets were added.

In a typical embodiment, the embossments 130 protrude from the lower face of the sheet 10 by about 1 to 1.5 mils. Greater or lesser amounts of protrusion can be provided depending upon the shape and size of the protuberances 125 on the embossing roller.

Figure 12:
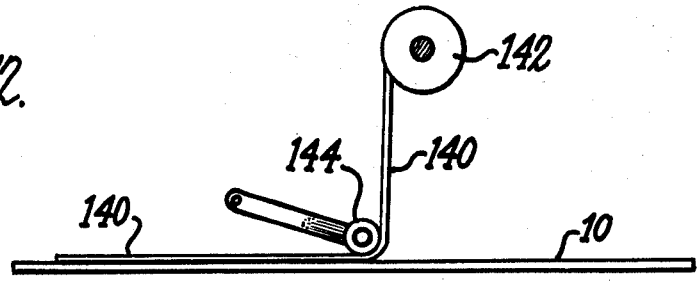
FIG. 12 shows a modified form of the invention involving the application of tape to the steel sheet.

While I much prefer to increase the effective thickness of one side of the sheet by providing the sheet with appropriately located embossments, there are other ways for obtaining the desired increases in effective thickness. One such way is to provide appropriate sheets 14 with a suitable tape in the required location. This is illustrated in FIG. 12 where a tape 140 is shown being applied to sheet 10. The tape is applied so that the entire length of each sheet 14 that it is desired to thicken will have tape on it. The tape is unwound from a reel 142 and is applied with a pressure-applying roll 144. When it is desired to discontinue application of the tape, roll 144 is lifted and the tape cut off at a suitable spot.

The tape should be of an inorganic material such as fibre glass having an adhesive on one side that is inorganic, or at least low in carbon content. An example of a suitable adhesive is a phosphate cement. It is desirable to avoid using for the tape materials that will be converted by the subsequent annealing operation into carbon or high-carbon content residues, which can cause magnetic aging or be otherwise detrimental to the steel or can cause electrical problems in the final transformer.

The fibre-glass tape has a relatively slick outer surface. This slickness is advantageous because it allows any protruding lamination that has tape on it to be forced laterally into its proper position without excessive frictional opposition and without dislodging the tape.

Another way of thickening one side of the sheet 10 is to apply a layer of adherent inorganic powder to the sheet 10 in the appropriate location, which could be the same location as where the tape 140 is applied in FIG. 12. By controlling the amount of powder applied, the thickness of powder coating can be controlled.

An additional advantage of limiting telescoping to a low value is that the above-described hammering and pressing has a tendency to enlarge the minimum gap length between the juxtaposed edges of previously telescoped sheets. For example, referring to FIG. 6, there is shown a generally V-shaped gap 111 between sheets 14*a* and 14*b*. Hammering and pressing of the sheets while in the annulus converts this gap into one of approximately uniform length but of a greater minimum length than the V-shaped gap. This longer gap introduces greater core losses than a shorter one would. By preventing substantial telescoping from occurring, a shorter gap having lower core losses can be obtained in the final core.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim is:

1. A method of making a wound core for a transformer, comprising:

(a) providing a plurality of elongated sheets primarily of magnetic steel, each sheet having a longitudinally-extending center line located between laterally opposed sides of the sheet, (b) winding said sheets in superposed relationship about an arbor, thereby forming an annulus of gradually increasing diameter surrounding the arbor, (c) sensing any telescoping action by said sheets as they are wound about said arbor and the direction of such telescoping action considered laterally of said elongated sheets, (d) following the occurrence of a predetermined amount of said telescoping action in a sheet, providing sheets that subsequently enter said annulus with thickening means effectively thickening said subsequent sheets at one side relative to their other side, the thickened side being located at a side of said sheet center line opposite to the lateral direction in which said telescoping occurs, and (e) removing said annulus from said arbor after a predetermined number of sheets have been wound about said arbor.

2. The method of claim 1 in which the provision of said thickening means comprises the step of providing said subsequent sheets with embossments at their thickened side.

3. The method of claim 2 in which said embossments are formed on one face of a sheet by indenting the opposite face of the sheet.

4. The method of claim 2 in which said embossments are provided at spaced-apart locations along substantially the full length of the sheets that are provided with embossments.

5. The method of claim 2 in which said embossments are provided at spaced-apart locations along the length of the embossed sheets, the embossments on an embossed sheet being elongated and running generally perpendicular to the longitudinally center line of the embossed sheet.

6. The method of claim 4 or 5 in which successive ones of said embossments are located at different distances from one longitudinal edge of an embossed sheet.

7. The method of claim 1, 2 or 3 in which said sheets have a thickness before any thickening substantially less than 11 mils and of about 9 mils or less.

8. The method of claim 1 in which the provision of said thickening means comprises the step of applying tape to said subsequent sheets at their thickened side.

9. The method of claim 1 in which the provision of thickening means is discontinued when said telescoping action has been reduced below a second predetermined amount.

10. The method of claim 1 in which said thickening means is provided to said sheets only so long as said telescoping action exceeds a prescribed amount.

11. The method of claim 1 in which:

(a) said plurality of sheets are made by cutting a parent sheet at a plurality of locations along its length to form between successive locations the individual sheets of said plurality of sheets, (b) the individual sheets of said plurality are successively fed onto said arbor as they are cut from said parent sheet, the leading edges of respective individual sheets being fed onto said arbor in close proximity to the trailing edge of the immediately-preceding sheet, (c) said thickening means is applied to said parent sheet before said parent sheet is cut into said plurality of sheets.

12. The method of claim 1 in which:

(a) said plurality of sheets are made by cutting a parent sheet at a plurality of locations along its length to form between successive locations the individual sheets of said plurality of sheets, (b) the individual sheets of said plurality are successively fed onto said arbor as they are cut from said parent sheet, the leading edges of respective individual sheets being fed onto said arbor in close proximity to the trailing edge of the immediately-preceding sheet.

13. A method as defined in claim 1 and including the following additional step:

applying laterally-directed pressure to said annulus to force protruding sheets laterally of the annulus into positions of closer edge-alignment with the other sheets.

14. A method as defined in claim 11 and including the following additional step:

applying laterally-directed pressure to said annulus to force protruding sheets laterally of the annulus into positions of closer edge-alignment with the other sheets.

15. A method as defined in claim 12 and including the following additional step:

applying laterally-directed pressure to said annulus to force protuding sheets laterally of the annulus into positions of closer edge-alignment with the other sheets.

* * * * *